US010876523B2

(12) United States Patent
Bridges

(10) Patent No.: US 10,876,523 B2
(45) Date of Patent: Dec. 29, 2020

(54) WELL SERVICE PUMP SYSTEM

(71) Applicant: AMERIFORGE GROUP INC., Houston, TX (US)

(72) Inventor: Bill P. Bridges, Colleyville, TX (US)

(73) Assignee: AMERIFORGE GROUP INC., Houston, TX (US)

( * ) Notice: Subject to any disclaimer, the term of this patent is extended or adjusted under 35 U.S.C. 154(b) by 705 days.

(21) Appl. No.: 14/512,039

(22) Filed: Oct. 10, 2014

(65) Prior Publication Data

US 2015/0192117 A1 Jul. 9, 2015

Related U.S. Application Data

(60) Provisional application No. 61/865,331, filed on Aug. 13, 2013.

(51) Int. Cl.
*F04B 23/06* (2006.01)
*F04B 47/02* (2006.01)
(Continued)

(52) U.S. Cl.
CPC ..... *F04B 23/06* (2013.01); *F04B 7/02* (2013.01); *F04B 9/111* (2013.01); *F04B 17/05* (2013.01); *F04B 47/02* (2013.01)

(58) Field of Classification Search
CPC .. F04B 1/02; F04B 23/06; F04B 47/02; F04B 9/111; F04B 11/005; F04B 11/0058;
(Continued)

(56) References Cited

U.S. PATENT DOCUMENTS 2,766,701 A 10/1956 Giraudeau ..... 417/568
3,773,438 A * 11/1973 Hall ..... E21B 43/26 417/345

(Continued)

FOREIGN PATENT DOCUMENTS

DE 202016103412 7/1916
WO WO 2017/096488 6/1917

(Continued)

OTHER PUBLICATIONS

Wehr Oil & Gas, TWS 2500, http://www.weiroilandgas.com/products services/well_service_stimulation/well_service-stimulation_pumps/destiny%E2%84%A2_tws_2500.aspx?tab=downloads, Accessed: Sep. 14, 2015.

(Continued)

*Primary Examiner* — Dominick L Plakkoottam
(74) *Attorney, Agent, or Firm* — Norton Rose Fulbright US LLP

(57) ABSTRACT

A well service pump system supplies high pressure working fluid to a well. The pump system is a linear design which incorporates a diesel engine, a hydraulic drive gear box, open loop hydraulic Pumps, hydraulic ram cylinders, controls for the hydraulic system hydraulic cylinders, working fluid end cylinders and a coupling to connect the hydraulic cylinders and the working fluid ends. The engine powers the hydraulic system which, in turn, provides hydraulic fluid to operate the hydraulic ram cylinders. Each of the polished rods of the hydraulic ram cylinders is connected axially to a plunger rod end of a working fluid end cylinder. There is no crankshaft or automatic transmission required. The linear design allows for a longer plunger stroke length while still allowing highway transport on a truck or skid.

34 Claims, 12 Drawing Sheets

(51) Int. Cl.

| | |
|---|---|
| ***F04B 9/111*** | (2006.01) |
| ***F04B 7/02*** | (2006.01) |
| ***F04B 17/05*** | (2006.01) |
| ***F04B 13/00*** | (2006.01) |

(58) Field of Classification Search
CPC .. F04B 15/00; F04B 2201/0201; F04B 47/00; F04B 49/007; F04B 49/065; F04B 49/22; F04B 53/14; F04B 9/1178
See application file for complete search history.

(56) References Cited

U.S. PATENT DOCUMENTS

| | | | | |
|---|---|---|---|---|
| 3,792,939 | A * | 2/1974 | Zalis | F04B 1/02 277/511 |
| 3,847,511 | A * | 11/1974 | Cole | F04B 1/02 137/596 |
| 3,967,542 | A * | 7/1976 | Hall | F01B 11/02 417/454 |
| 4,269,569 | A * | 5/1981 | Hoover | F04B 49/007 417/347 |
| 4,470,771 | A * | 9/1984 | Hall | F04B 9/1178 417/342 |
| 4,500,267 | A | 2/1985 | Birdwell | |
| 4,606,709 | A | 8/1986 | Chisolm | |
| 5,246,355 | A | 9/1993 | Matzner et al. | 417/521 |
| 5,259,731 | A * | 11/1993 | Dhindsa | F04B 49/065 417/3 |
| 5,385,452 | A * | 1/1995 | Lyday | F01B 11/02 417/403 |
| 5,839,888 | A | 11/1998 | Harrison | 417/521 |
| 6,126,401 | A | 10/2000 | Latham | |
| 6,454,542 | B1 | 9/2002 | Back | |
| 6,827,479 | B1 * | 12/2004 | Xia | B01F 3/0807 366/162.4 |
| 7,335,002 | B2 | 2/2008 | Vicars | |
| 7,845,413 | B2 | 12/2010 | Shampine et al. | |
| 8,465,268 | B2 | 6/2013 | Baxter et al. | |
| 8,591,200 | B2 | 11/2013 | Marica | |
| 8,789,601 | B2 | 7/2014 | Broussard et al. | |
| 9,121,257 | B2 | 9/2015 | Coli et al. | |
| 9,121,397 | B2 * | 9/2015 | Marica | F04B 17/048 |
| 9,322,397 | B2 | 4/2016 | Burnette | |
| 9,366,248 | B2 | 6/2016 | Marica | |
| 9,528,508 | B2 | 12/2016 | Thomeer et al. | |
| 9,989,053 | B2 | 6/2018 | Ladd et al. | |
| 10,119,381 | B2 | 11/2018 | Oehring et al. | |
| 2004/0167738 | A1 * | 8/2004 | Miller | F04B 51/00 702/114 |
| 2008/0008606 | A1 * | 1/2008 | Muth | F04B 35/045 417/398 |
| 2011/0123363 | A1 * | 5/2011 | Marica | F04B 5/00 417/279 |
| 2014/0290768 | A1 | 10/2014 | Randle et al. | |
| 2015/0027712 | A1 | 1/2015 | Vicknair et al. | |
| 2015/0192117 | A1 | 7/2015 | Bridges | |
| 2015/0308420 | A1 | 10/2015 | Donnally et al. | |
| 2017/0067459 | A1 | 3/2017 | Bayyouk et al. | |
| 2017/0089328 | A1 | 3/2017 | Sato et al. | |
| 2017/0108014 | A1 | 4/2017 | Handle et al. | |
| 2017/0218951 | A1 | 8/2017 | Graham et al. | |
| 2017/0226998 | A1 | 8/2017 | Zhang et al. | |
| 2017/0292358 | A1 | 10/2017 | Elish et al. | |
| 2018/0119689 | A1 | 5/2018 | Van de Ven et al. | |
| 2018/0266412 | A1 | 9/2018 | Stokkev et al. | |
| 2018/0274536 | A1 | 9/2018 | Ladd et al. | |
| 2018/0363642 | A1 | 12/2018 | Salih et al. | |

FOREIGN PATENT DOCUMENTS

| | | |
|---|---|---|
| WO | WO 9222748 | 12/1992 |
| WO | WO 2016/207631 | 12/2016 |
| WO | WO 2018/101909 | 6/2018 |

OTHER PUBLICATIONS

Wehr Oil & Gas, QWS 2500SD, http://www.weiroilandgas.com/products_services/well_service stimulation/well_service-stimulation_pumps/qws_2500sd.aspx?tab=features, Accessed: Sep. 14, 2015.

International Preliminary Report on Patentability Issued in Corresponding PCT Patent Application No. PCT/US2019/029465, dated May 12, 2020.

Written Opinion Issued in Corresponding PCT Patent Application No. PCT/US2019/029475, dated Apr. 2, 2020.

Written Opinion Issued in Corresponding PCT Application No. PCT/US2019/029480, dated Mar. 30, 2020.

International Search Report and Written Opinion issued in International Application No. PCT/US2019/029480, dated Jul. 11, 2019.

International Search Report and Written Opinion issued in Corresponding International Patent Application No. PCT/US2019/029475, dated Jul. 9, 2019.

International Preliminary Report on Patentability Issued in Corresponding PCT Patent Application No. PCT/US2019/029475, dated Jun. 24, 2020.

International Preliminary Report on Patentability Issued in Corresponding PCT Patent Application No. PCT/US2019/029480, dated Jun. 19, 2020.

* cited by examiner

WELL SERVICE PUMP SYSTEM

CROSS-REFERENCE TO RELATED APPLICATIONS

The application claims priority to U.S. Provisional Patent Application No. 61/865,331 filed Aug. 13, 2013, which is incorporated by reference in its entirety.

BACKGROUND

1. Field of Invention

The present invention relates generally to pumping assemblies used for well servicing applications, most particularly pumping assemblies used for well fracturing operations.

2. Description of Related Art

Oil and gas wells require services such as fracturing, acidizing, cementing, sand control, well control and circulation operations. All of these services require pumps for pumping fluid down the well. The type of pump that has customarily been used in the industry for many years is a gear driven plunger type, which may be referred to as a "frac pump." The pump is often powered by a diesel engine, typically 2,000 bhp or larger, that transfers its power to a large automatic transmission. The automatic transmission then transfers the power through a large driveline, into a gear reduction box mounted on the frac pump. The frac pump has a crankshaft mounted in a housing. A plunger has a crosshead that is reciprocally carried in a cylinder perpendicular to the crankshaft. A connecting rod connects each eccentric portion or journal of the crankshaft to the plunger. The driveline enters the frac pump at a right angle to the connecting rods, plungers and pump discharge. A typical pump might be, for example, a triplex type having three cylinders, three connecting rods, and three journals on the crankshaft. An example of a common type of a well service pump (e.g., plunger pump) is disclosed in U.S. Pat. No. 2,766,701 to Giraudeau. Typical commercially available pumps include the Weir/SPM™ line of pumps, for example, the QWS 2500 Classic™ Well Service Pump and the Destiny TWS2500™ Well Service Pump.

There are a number of known problems with the prior art plunger pumps of the type under consideration. These pumps will typically be mounted on a trailer or skid back-to-back. The frac pumps are mounted at a right angle to the engine, transmission and driveline. Each pump has an outboard side connected to a manifold with valves for drawing in and pumping fluid acted on by the plunger. The inboard sides will be located next to each other. The overall width from one manifold to the other manifold should not exceed roadway requirements, e.g., Department of Transportation (DOT) rules and regulations. If the pumps are to be trailer mounted for highway transport, this distance will be on the order of about eight and one half feet. As a result, this necessarily means that the frac units which are trailer mounted will be restricted in size by the applicable DOT rules and regulations. The current plunger stroke length for present day frac pumps is typically 8 to 10 inches. However, in order to meet DOT requirements, some manufacturers have reduced the size of the pump, for example reducing the pump stroke, in some cases down to as much as four to six inches.

However, reducing the stroke length of the plungers is not an ideal solution to the problem and, in fact, offers a number of disadvantages in the design. Ideally, it would be desirable to lengthen the stroke of these pumps instead of shortening the stroke length, in order to reduce cycles per minute in use. This is due to the fact that there is a tremendous failure rate in current frac pump fluid ends, due to cyclic fatigue. The increased failure rate results from increased demand placed upon today's frac pumps, as compared to the practice in prior years. An example of a typical frac job in shale formations today would be a five hour pump time. During this pump time the plunger cycles would be, for example, 250 per minute at 10,000 psi. There has not been a great deal of change in the design of basic frac pumps going back some fifty years. However, the prior art designs of fifty years ago were intended for frac jobs that might last up to 2 hours. The unit would then typically be shut down until the next day. During today's frac jobs, for example in commonly encountered shale formations, the units are pumping 4-8 hours at higher pressures than in the past. The units are then typically shut down for an hour or two and then started up again for another stage for approximately the same duration. This type of operation may exceed the intended design limits of the units.

It has also been attempted in the past, especially with the larger oil field pumps, to increase the stroke length by offsetting the crankshaft axis with the cylinder axis. The offset is selected so that during the power or output stroke, the centerline of the crankshaft end of the connecting rod will be located closer to the cylinder axis than the crankshaft axis. Matzner et al. disclose vertically offsetting the cylinder axis from the crankshaft axis in U.S. Pat. No. 5,246,355. It has also been attempted for the axis of the wrist pin of the connecting rod to be vertically offset from the cylinder axis to achieve the width requirements. An example of a plunger pump having an offset wrist pin is disclosed in U.S. Pat. No. 5,839,888 to Harrison. However, these designs still suffer from all of the problems of having the frac pump mounted at a right angle to the engine, transmission and driveline. They also fail to reduce the mechanical complexity of the system and, in fact, likely increase the complexity.

With prior art designs, it will be very difficult to increase the plunger stroke length much more than 10 to 12 inches. For example, increasing the stroke length by one inch may necessitate increasing total length of the frac pump by at least two inches due to the crankshaft design. This can put frac pumps in violation of DOT standards regarding the width of the trailer mounted frac unit, since the pump sits at a right angle to the engine, transmission and driveline.

For these and other reasons, a need continues to exist for improvements in oil and gas well servicing pumps of the type under consideration.

SUMMARY

The present disclosure includes embodiments of pump systems and methods.

Some embodiments of the present well service pumps and pump systems incorporate a diesel engine, a hydraulic drive gear box, open loop hydraulic pumps, hydraulic ram cylinders, controls for the hydraulic system hydraulic cylinders, working fluid end cylinders and a coupling or bracket to connect the hydraulic ram cylinders and the working fluid end cylinders. In such embodiments, the engine can power the hydraulic system which in turn can provide hydraulic fluid to operate the hydraulic ram cylinders. In such embodiments, each hydraulic ram cylinder has a piston rod which is attached by the coupling to a plunger rod of the working cylinder fluid end. At least some of such embodiments do not include a crankshaft or automatic transmission.

Some embodiments of the present well service pump systems (e.g., for delivering fracturing fluid at high pressure to a well) comprise: at least two working fluid pump assemblies (each comprising: a working fluid end cylinder having an end cylinder housing, a plunger rod configured to reciprocate in the end cylinder housing; and a hydraulic ram cylinder having a ram cylinder housing, a ram piston configured to reciprocate in the ram cylinder housing, and a piston rod coupled to the ram piston and coupled to the plunger rod of the working fluid end cylinder such that piston of the hydraulic ram cylinder can be actuated to move the plunger rod of the working fluid end cylinder: in a first direction to expel working fluid from the end cylinder housing during a forward stroke of the plunger rod, and in a second direction to draw working fluid into the end cylinder housing during a return stroke of the plunger rod); a valve system configured to be coupled to a source of pressurized driving fluid and to the hydraulic ram cylinder of each of the working fluid pump assemblies to direct pressurized working fluid to and from the hydraulic ram cylinders; and a control system coupled to the valve system and configured to sequentially actuate the hydraulic ram cylinders to deliver a continuous and substantially pulseless output flow of the working fluid from the pump system to the well. Some embodiments further comprise: a source of pressurized driving fluid.

In some embodiments of the present well service pump systems, each working fluid pump assembly further comprises: a coupling member coupled to the plunger rod of the working fluid end cylinder and to the piston rod of the hydraulic ram cylinder. In some embodiments, the piston rod of the hydraulic ram cylinder is axially aligned with the plunger rod of the hydraulic ram cylinder.

In some embodiments of the present well service pump systems, in each working fluid pump assembly, the end cylinder housing of the working fluid end cylinder has a cylindrical inner wall defining an end cylinder inner diameter, the plunger rod has an outer surface that is spaced apart from the cylindrical inner wall such that the working fluid end cylinder can pump abrasive fluids without the plunger rod and the end cylinder inner wall simultaneously contacting individual particles in the working fluid. In some embodiments, the outer diameter of the plunger rod is between 70 percent and 98 percent of the inner diameter of the cylindrical inner wall. In some embodiments, the outer diameter of the plunger rod is between 85 percent and 95 percent of the inner diameter of the cylinder inner wall. In some embodiments, the plunger rod has a length that exceeds 12 inches (e.g., exceeds 40 inches and/or is between 50 inches and 60 inches).

In some embodiments of the present well service pump systems, the source of driving fluid comprises: a diesel engine; a hydraulic drive gear box coupled to an output shaft of the diesel engine; and one or more hydraulic pumps coupled to the hydraulic drive gear box. In some embodiments, the hydraulic pump(s) each comprises a variable-displacement hydraulic pump. In some embodiments, the working fluid pump assemblies do not include a crank shaft, and the system does not include an automatic transmission. In some embodiments, in each working fluid pump assembly: the ram cylinder housing includes a first port on a first side of the ram piston and second port on a second side of the ram piston.

In some embodiments of the present well service pump systems, each working fluid pump assembly further comprises: an inlet check valve coupled to the end cylinder housing and configured to permit working fluid to be drawn into the end cylinder housing but prevent working fluid from exiting the end cylinder housing through the inlet check valve; and an outlet check valve coupled to the end cylinder housing and configured to permit working fluid to exit the end cylinder housing while preventing working fluid from being drawn into the end cylinder housing. In some embodiments, in each working fluid pump assembly, the outlet check valve and inlet check valve are each disposed at least partially in the end cylinder housing. Some embodiments Some embodiments further comprise: a suction manifold coupled to the inlet check valves of the working fluid pump assemblies; and a discharge manifold coupled to the outlet check valves of the working fluid pump assemblies. In some embodiments, the suction manifold includes a plurality of inlet flow channels each coupled to a different one of the working fluid pump assemblies via the corresponding inlet check valve, each inlet flow channel having a cross-sectional area at least as large as the cross-sectional area of the interior of the working fluid end cylinder of the coupled working fluid pump assembly. In some embodiments, the discharge manifold includes a plurality of outlet flow channels each coupled to a different one of the working fluid pump assemblies via the corresponding outlet check valve, each outlet flow channel having a cross-sectional area that is smaller than the cross-sectional area of the interior of working fluid end cylinder of the coupled working fluid pump assembly. In some embodiments, the valve system further comprises for each of the working fluid pump assemblies: a directional control valve coupled to the source of pressured driving fluid and configured to selectively direct pressurized driving fluid to the first port or to the second port. In some embodiments, each working fluid pump assembly is configured such that directing pressurized driving fluid to the first port instead of the second port actuates the hydraulic ram cylinder to drive the plunger rod in the first direction, and directing pressurized fluid to the second port instead of the first port actuates the hydraulic ram to drive the plunger rod in the second direction. In some embodiments, the directional control valve is configured to be electronically controlled to control of the position of the corresponding piston.

In some embodiments of the present well service pump systems, the control system comprises a processor or programmable logic controller (PLC) configured to sequentially actuate the working fluid pump assemblies such that the hydraulic ram cylinder of a first one of the working fluid pump assemblies is beginning its forward stroke as the hydraulic ram cylinder of a second one of the working fluid pump assemblies is ending its forward stroke. In some embodiments, the processor or PLC is configured to sequentially actuate the working fluid pump assemblies such that the hydraulic ram cylinder of a third one of the working fluid pump assemblies is beginning its forward stroke when the hydraulic ram cylinder of the first one of the working fluid pump assemblies is one half of the way through its forward stroke. In some embodiments, the two or more working fluid pump assemblies comprises a number of working fluid pump assemblies that is a multiple of three. In some embodiments, the processor or PLC is configured to actuate each of the working fluid pump assemblies, via adjustment of the source of pressurized working fluid and/or adjustment of the valve system, such that the duration of the forward stroke is twice the duration of the return stroke. In some embodiments, the control system further comprises: a plurality of position sensors each coupled to a different one of the hydraulic ram cylinders and configured to detect the position of the ram piston in the ram cylinder housing. In some embodiments, the processor of PLC is coupled to the plurality of position sensors and is further configured to adjust the timing of actuation of the working fluid pump assemblies based on the detected positions of the ram pistons.

Some embodiments of the present well service pumps (e.g., for delivering fracturing fluid at high pressure to a well) comprise: a working fluid end cylinder having an end cylinder housing, a plunger rod configured to reciprocate in the end cylinder housing; a hydraulic ram cylinder (e.g., having a ram cylinder housing, a ram piston configured to reciprocate in the ram cylinder housing, and a piston rod coupled to the ram piston and configured to be coupled to the plunger rod of the working fluid end cylinder such that piston of the hydraulic ram cylinder can be actuated to move the plunger rod of the working fluid end cylinder: in a first direction to expel working fluid from the end cylinder housing during a forward stroke of the plunger rod, and in a second direction to draw working fluid into the end cylinder housing during a return stroke of the plunger rod). In some embodiments, each working fluid pump assembly further comprises: a coupling member configured to couple to the plunger rod of the working fluid end cylinder and to the piston rod of the hydraulic ram cylinder. In some embodiments, the piston rod is configured to be coupled in a axially aligned relation to the plunger rod. In some embodiments, the end cylinder housing of the working fluid end cylinder has a cylindrical inner wall defining an end cylinder inner diameter, the plunger rod has an outer surface that is spaced apart from the cylindrical inner wall such that the working fluid end cylinder can pump abrasive fluids without the plunger rod and the end cylinder inner wall simultaneously contacting individual particles in the working fluid. In some embodiments, the outer diameter of the plunger rod is between 70 percent and 98 percent of the inner diameter of the cylindrical inner wall. In some embodiments, the outer diameter of the plunger rod is between 85 percent and 95 percent of the inner diameter of the cylinder inner wall. In some embodiments, the plunger rod has a length that exceeds 12 inches (e.g., exceeds 40 inches and/or is between 50 inches and 60 inches).

In some embodiments of the present well service pumps, the ram cylinder housing includes a first port on a first side of the ram piston and second port on a second side of the ram piston. Some embodiments further comprise: an inlet check valve coupled to the end cylinder housing and configured to permit working fluid to be drawn into the end cylinder housing but prevent working fluid from exiting the end cylinder housing through the inlet check valve; and an outlet check valve coupled to the end cylinder housing and configured to permit working fluid to exit the end cylinder housing while preventing working fluid from being drawn into the end cylinder housing. In some embodiments, the outlet check valve and inlet check valve are each disposed at least partially in the end cylinder housing. Some embodiments further comprise: a position sensor coupled to at least one of the hydraulic ram cylinder and the working fluid end cylinder. Some embodiments further comprise: a position indicator coupled to at least one of the piston, piston rod, and plunger rod.

Some embodiments of the present methods comprise: delivering fluid to a well with an embodiment of the present well service pump systems or well service pumps.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments described above and others are described below.

DETAILED DESCRIPTION OF ILLUSTRATIVE EMBODIMENTS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

Figure 1:
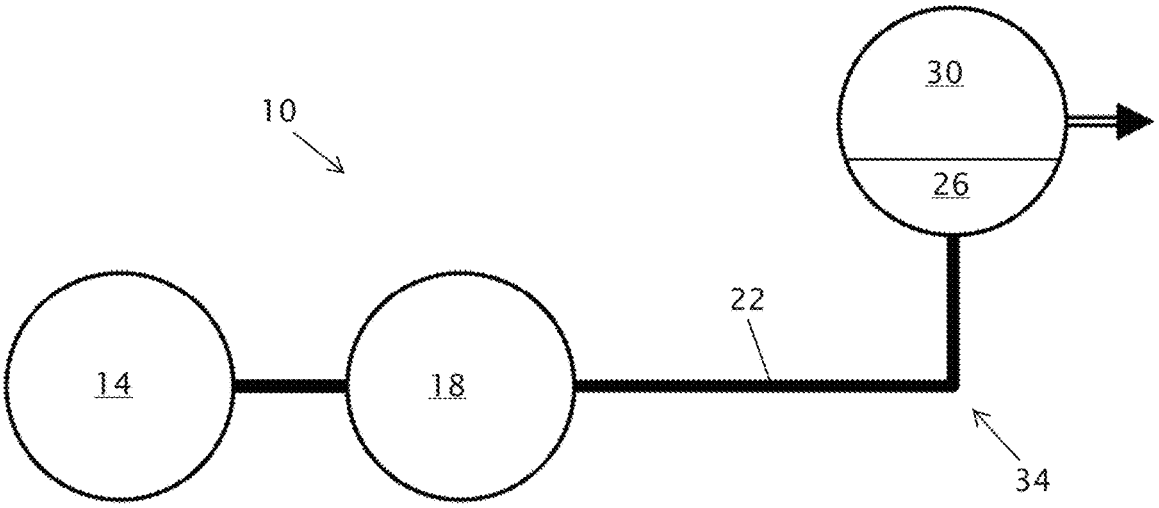
FIG. 1 is a simplified, schematic diagram of the operative components of a prior art well service pump system.

FIG. 1 is a simplified, schematic flow diagram of a prior art well service pump system 10 of the type toward which the improvements of the present invention are directed. As has been briefly discussed, such well service pumps typically utilize a diesel engine 14, which will usually be 2,000 bhp or larger. The diesel engine transfers its power to a large automatic transmission 18. Transmission 18 then transfers power through a large driveline 22 into a gear reduction box 26 mounted on the frac pump 30. The driveline enters the frac pump at a right angle to the connecting rods, plungers and pump discharge (illustrated in simplified fashion generally at 34 in FIG. 1).

Figure 2:
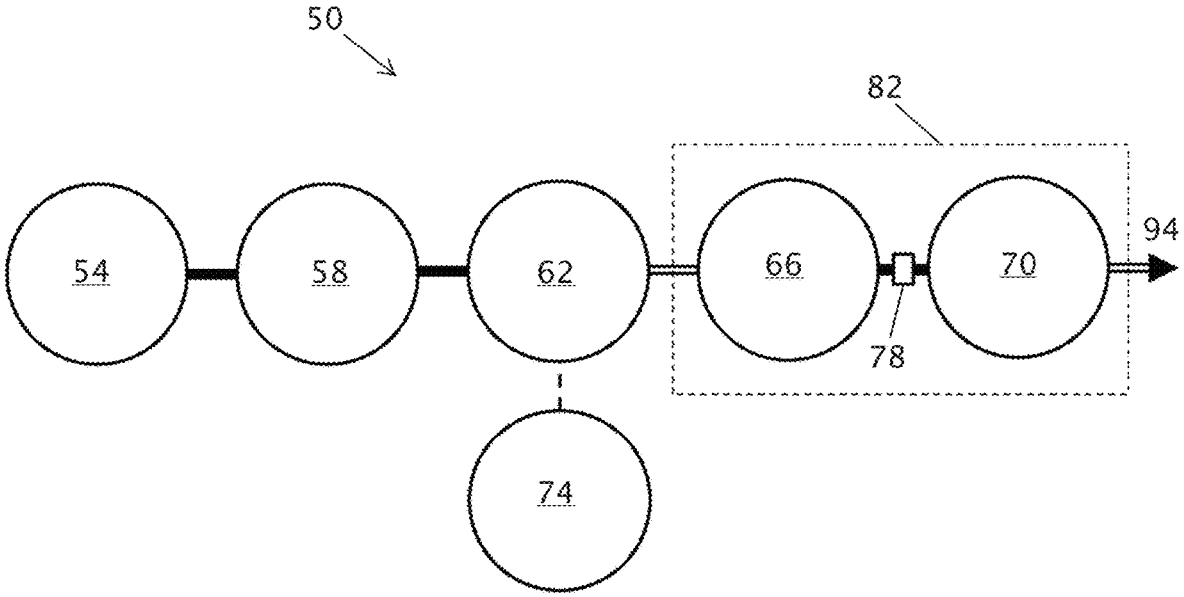
FIG. 2 is a simplified, schematic diagram of the operative components of an embodiment of the present well service pump systems.

The operation of one embodiment 50 of the present well service pump systems is illustrated in simplified fashion in FIG. 2. As has been briefly described, a diesel engine 54 and hydraulic gear box 58 provide power to one or more open loop hydraulic pumps 62 which provide a source of driving fluid under high pressure. The diesel engine and hydraulic gear box are commercially available and will be familiar to those skilled in the relevant industry. Hydraulic pumps 62 provide the driving fluid to operate the hydraulic ram cylinders 66 which, in turn, operate the fluid end cylinders 70 to pump working fluid into a well under high pressure. The hydraulic pumps may be obtained commercially, for example the Parker™ P16 Series, available from Parker Hannifin Corporation.

A hydraulic control system 74 controls the supply of driving fluid to the hydraulic ram cylinders 66. As will be discussed more fully with respect to FIG. 3, it will be appreciated from the simplified schematic view presented in FIG. 2 that the hydraulic ram cylinder piston rods and the plunger rods of the working fluid end cylinders are located in-line, in linear fashion (connected by a coupling member 78). This is to be contrasted to the right angle arrangement of the driveline 22 and pump gear box 26 shown in the prior art system of FIG. 1.

Figure 3:
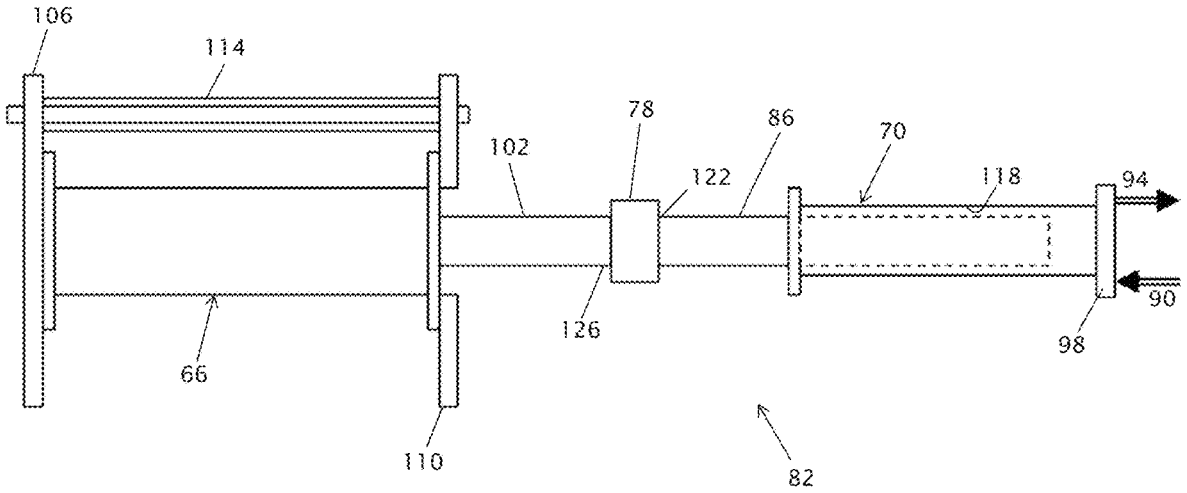
FIG. 3 is a simplified view of an in-line hydraulic cylinders, piston rods, plunger rods and working fluid end cylinders used in the pump system of FIG. 2.
Figure 4:
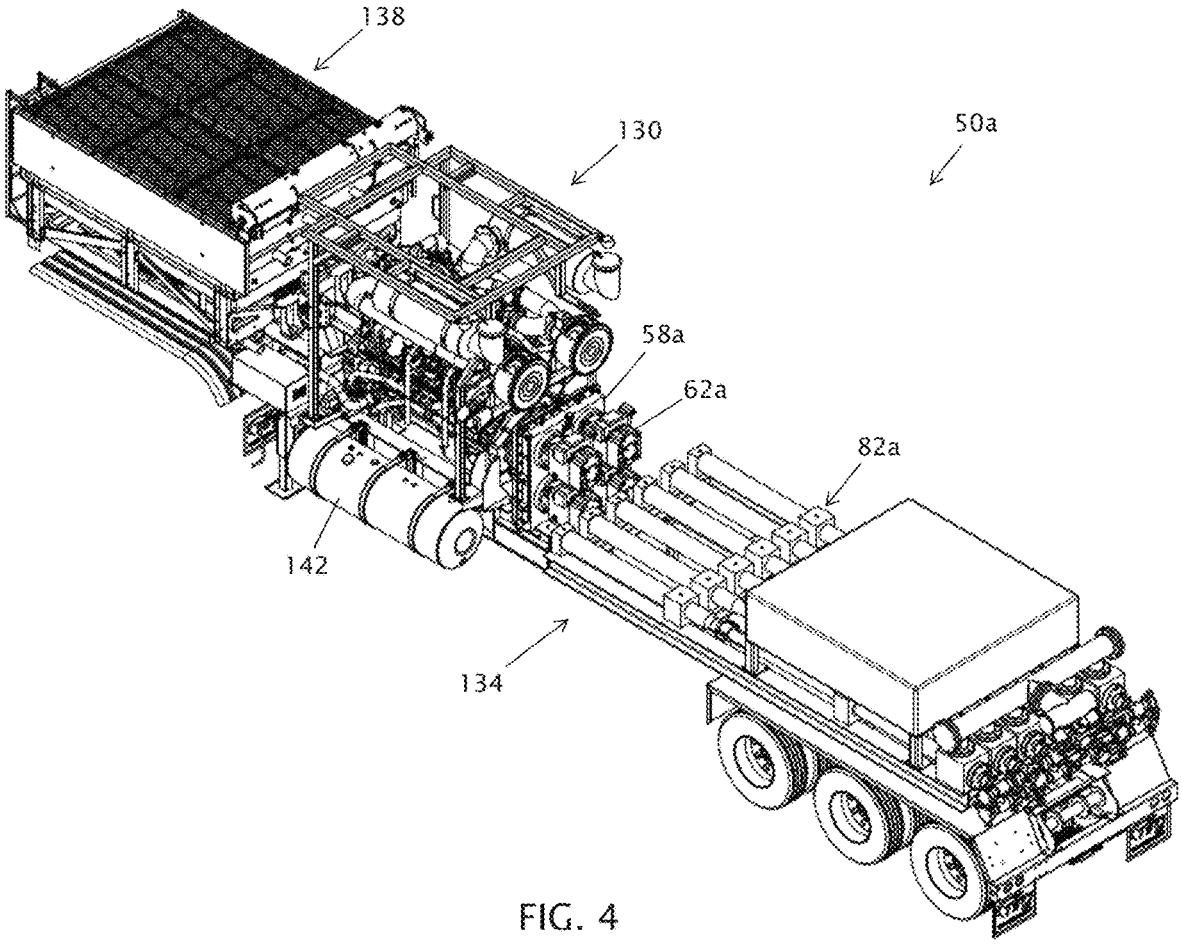
FIG. 4 depicts a perspective view of a second embodiment of the present well service pump systems.
Figure 5:
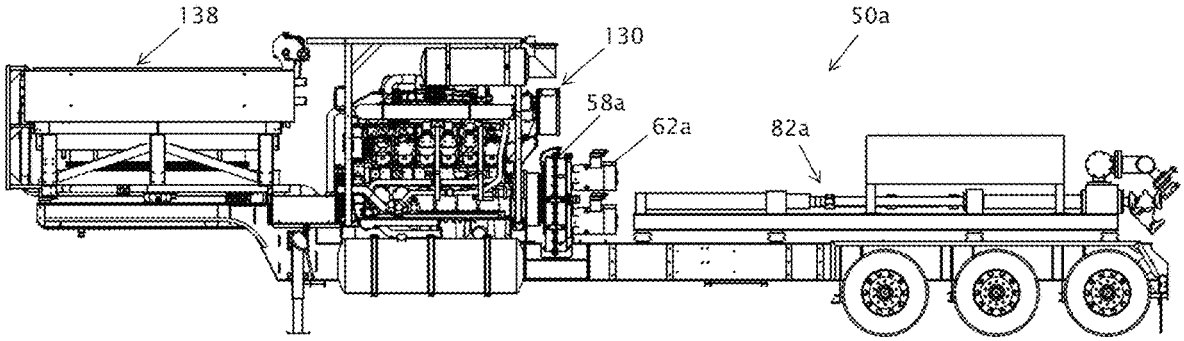
FIG. 5 depicts a side view of the system of FIG. 4.
Figure 6:
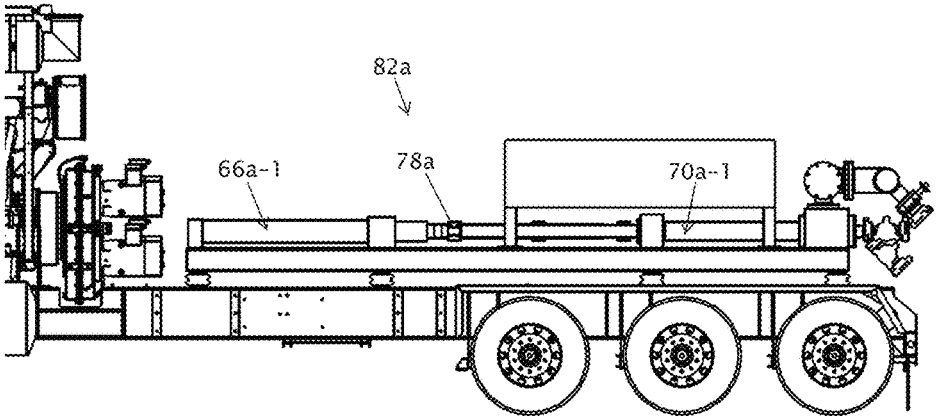
FIG. 6 depicts an enlarged side view of a working fluid pump assembly portion of the system of FIG. 4.

FIG. 3 is a simplified view of a working fluid pump assembly 82 that includes the in-line components of system 50, as shown. More particularly, FIG. 3 shows one of the hydraulic ram fluid cylinders 66 and associated working fluid end cylinder 70. Preferably at least two units or assemblies 82 are provided for a system 50, each assembly 82 being sequentially operated to reciprocate working fluid end cylinder 70. Each of working fluid end cylinders 70 includes a reciprocating plunger rod 86 for supplying a working fluid under high pressure to the well. The inlet or entrance 90 and outlet or exit 94 for the working fluid are illustrated in simplified fashion. In the embodiment shown, system 50 includes an in-line discharge valve 98 which eliminates the need for right angle components and consequently reduces the metal fatigue in the fluid end cylinder.

As shown in FIG. 3, hydraulic ram cylinder 66 has a ram piston rod 102 which is connected for operating each of the working fluid ends. In the embodiment shown, a coupling member or bracket 78 is operably connected between piston rod 102 and plunger rod 86 so that the piston rod and plunger rod are arranged in an in-line, linear fashion. Each hydraulic ram fluid cylinders 66 of a system 50 can conveniently be mounted on the bed of a truck or skid by means of a mounting flanges 106, 110 and stay rods 114.

The hydraulic ram fluid cylinders 43 can be, for example, the same type hydraulic cylinders that are used to power a traditional "snubbing unit." For an example snubbing unit, see the Hydra Rig™ HRP-2 commercially available unit.

As mentioned above, a valve system can be operably associated with each hydraulic ram cylinder for delivering driving fluid to each hydraulic ram cylinder at a driving pressure. A control system (74 in FIG. 2) is provided for operating the valve system to alternately pressurize each hydraulic ram cylinder on a forward stroke thereof and to depressurize the hydraulic ram cylinder on a return stroke thereof to thereby deliver a continuous and pulseless output flow of the working fluid from the working fluid end cylinders to the well.

In some embodiments, the system includes a directional control valve connected to the source of driving fluid and movable between a pressurizing position which admits driving fluid for pressurizing a respective ram cylinder at the beginning of its forward stroke and for exhausting the respective ram cylinder during its return stroke. One example of such a directional control valve is the Parker™ R04C3 Directional Control Valve available from Parker Hannifin Corporation.

In addition to the use of directional control valves, the present systems may also include one or more proportional control valves (sometimes called proportional throttle valves). The directional control valve controls the direction of the flow of the hydraulic fluid. In one position, it allows a hydraulic ram cylinder 66 to charge and in the other position it allows the ram piston to return. A proportional control valve component of the system can be computer controlled to provide real time, exact control of the position of the respective ram piston rod. An example would be the Parker™ TDP series valve. In some embodiments, for example, this can allow the system to have one ram piston accelerating one ram half way thru its travel while another ram decelerates, to closely approximate the timing of the current crankshaft designs, without the disadvantages of the crankshaft discussed above.

Hydraulic ram cylinder 66 has an internal diameter and internal cylindrical sidewalls, a piston (not shown in FIG. 3) with an outer diameter that fits closely and in a substantially sealed relationship with the inner cylindrical sidewalls as is typical for hydraulic power cylinders, and a piston rod 102 coupled to the piston and extending out of the cylinder housing as shown. In contrast, in the embodiment shown, working fluid end cylinder 70 includes a plunger rod 86 (e.g., a plunger that is unitary with and/or has a substantially equal outer diameter to that of the plunger rod, as shown). In this embodiment, the outer diameter of plunger rod 86 is smaller than the inner diameter of the inner diameter defined by inner walls 118 of the housing of fluid end cylinder 70, as shown. As such, plunger rod 86 is received in spaced-apart fashion from walls 118 so that abrasive fluids may be pumped without undue wear on the plunger rod or cylinder walls. For example, the space between the outer surface of the plunger rod and the inner walls of the housing of end cylinder 70 is larger than the largest expected transverse dimension of any particles in the working fluid to prevent any single particle in the working fluid from simultaneously contacting the outer surface of the plunger and the inner surface of the housing. In the embodiment shown, coupling member 78 is configured to couple a first rod end 122 of hydraulic ram cylinder 66 to a second rod end 126 of plunger rod 86 in order to achieve the in-line arrangement, and such that reciprocal movement of the rod of hydraulic ram cylinder 66 causes reciprocal movement of the plunger of working fluid end cylinder 70.

Referring now to FIGS. 4-14, a second embodiment 50*a* of the present system is shown. In the embodiment shown, system 50*a* comprises at least two (six in this embodiment) of working fluid pump assemblies 82*a* (82*a*-1, 82*a*-2, 82*a*-3, 82*a*-4, 82*a*-5, 82*a*-6) and a source of pressurized driving fluid 130. In the embodiment shown, system 50*a* is coupled to and carried by a trailer 134 (e.g., a semi trailer) for transportation to and from job sites for fracing operations. In other embodiments, system 50*a* can be coupled to a skid frame that can then be loaded onto and offloaded from a trailer. In the embodiment shown, the source of pressurized driving fluid (130) comprises: a diesel engine 54*a* (e.g., 2,500 HP), a hydraulic drive gear box 58*a* coupled to an output shaft of the diesel engine (e.g., crankshaft); one or more (e.g., four as shown) hydraulic pumps 62*a* coupled to hydraulic drive gear box 58*a*, and one or more hydraulic fluid reservoirs 138. Fuel for engine 54*a* may be carried by tanks 142 on trailer 134, or may be separately provided for at a work site. In the depicted embodiment, gear box 58*a* comprises a cotta box pump drive available from Cotta Transmission Company (Wisconsin). In this embodiment, each of pumps 62*a* comprises a variable-displacement hydraulic pump to permit adjustment of the rate at which ram cylinders 66*a* are actuated. The configuration of system 50*a* is such that an automatic transmission is not necessary, and such that the working fluid pump assemblies (82*a*) do not include a crank shaft.

In the embodiment shown, each working fluid pump assembly 82*a* comprises: a working fluid end cylinder 70*a* (70*a*-1, 70*a*-2, 70*a*-3, 70*a*-4, 70*a*-5, 70*a*-6) and a hydraulic ram cylinder 66*a* (66*a*-1, 66*a*-2, 66*a*-3, 66*a*-4, 66*a*-5, 66*a*-6). In this embodiment, working fluid end cylinder 70*a* includes an end cylinder housing 150 and a plunger rod 86*a* configured to reciprocate in the end cylinder housing. In this embodiment, hydraulic ram cylinder 66*a* includes a ram cylinder housing 154, a ram piston 156 configured to reciprocate in the ram cylinder housing. For example, in the embodiment shown, the bore of cylinder housing 154 has a diameter of 7 inches, and piston rod 102*a* has an outer diameter of 5 inches. In the depicted embodiment, each pump assembly 82*a* (via end cylinder housing 150 and ram cylinder housing 154) is connected in fixed relation to a rigid I-beam 158 which is, in turn, supported on trailer 134 by a plurality (e.g., four, as shown) vibration-dampening mounts 160. As shown, piston rod 102*a* is coupled to the ram piston and coupled to plunger rod 86*a* such that piston can be actuated to move the plunger rod: in a first direction 162 to expel working fluid from the end cylinder housing during a forward stroke of the plunger rod, and in a second direction 166 to draw working fluid into the end cylinder housing during a return stroke of the plunger rod. More particularly, in the embodiment shown, coupling member 78*a* couples first end 122*a* of plunger rod 86*a* to second end 126*a* of piston rod 102*a*. In the depicted embodiment, second end 126*a* of the piston rod is convex and first end 122*a* of plunger rod 86*a* is concave such that the convex and concave ends cooperate to center the rods relative to one another. In this embodiment, plunger rod 86*a* and piston rod 102*a* include annular grooves 170 adjacent to their respective ends, such that the grooves can receive bushings or journals 174 and radial protrusions 178 of coupling member 78*a* to resist separation of the plunger rod and piston rod.

In the embodiment shown, hydraulic ram cylinders 66*a* are similar to traditional hydraulic power cylinders in that housing 154 includes an cylindrical inner wall defining an inner diameter and piston 158 fits closely (e.g., in substantially sealed relation to) the inner wall such that delivery of pressurized driving (e.g., hydraulic) fluid to a first port 182 on a first side of piston 158 pushes piston 158 (and piston rod 102*a*) in first direction 162 to actuate the forward stroke of assembly 82*a*, and delivery of pressurized driving fluid to a second port 186 on a second, opposite side of piston 158 pushes piston 158 (and piston rod 102*a*) in second direction 166 to actuate the return stroke of assembly 82*a*. In contrast, in the embodiment shown, working fluid end cylinder housing 150 has a cylindrical inner wall 190 defining an inner diameter 194, and plunger rod 86*a* has a cylindrical outer surface 198 that is spaced apart from cylindrical inner wall 10 such that the working fluid end cylinder can pump abrasive fluids without the plunger rod and the end cylinder inner wall simultaneously contacting individual particles in the working fluid. An outer diameter 202 of the portion of the plunger rod that enters housing 150 may be between 70 percent and 98 percent (e.g., between 85 percent and 95 percent) of inner diameter 194. For example, in the embodiment shown, inner diameter 194 is 5 inches and outer diameter 202 is 4.5 inches. In other embodiments, inner diameter 194 is 3.5 inches and outer diameter 202 is 3.25 inches (e.g., reduction of inner diameter 194 relative to the inner diameter of the bore of hydraulic ram cylinder 66*a* amplifies pressure in end cylinder 70*a* relative to hydraulic ram cylinder 66*a*.

Figure 10:
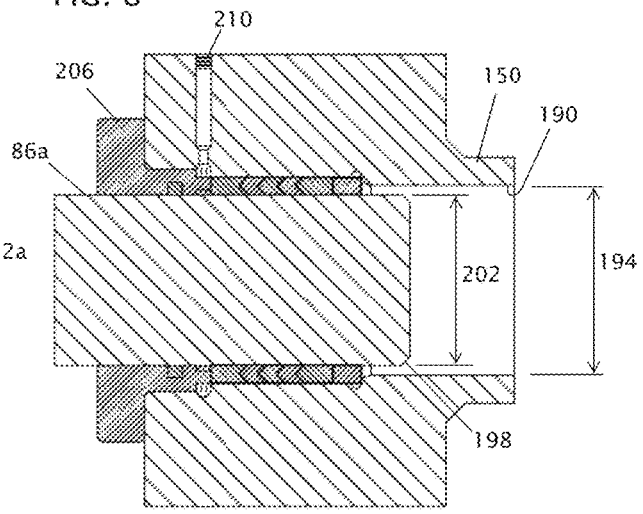
FIG. 10 depicts an enlarged, cross-sectional side view of a plunger and seal portion of working fluid end cylinder of the working fluid pump assembly.
Figure 11:
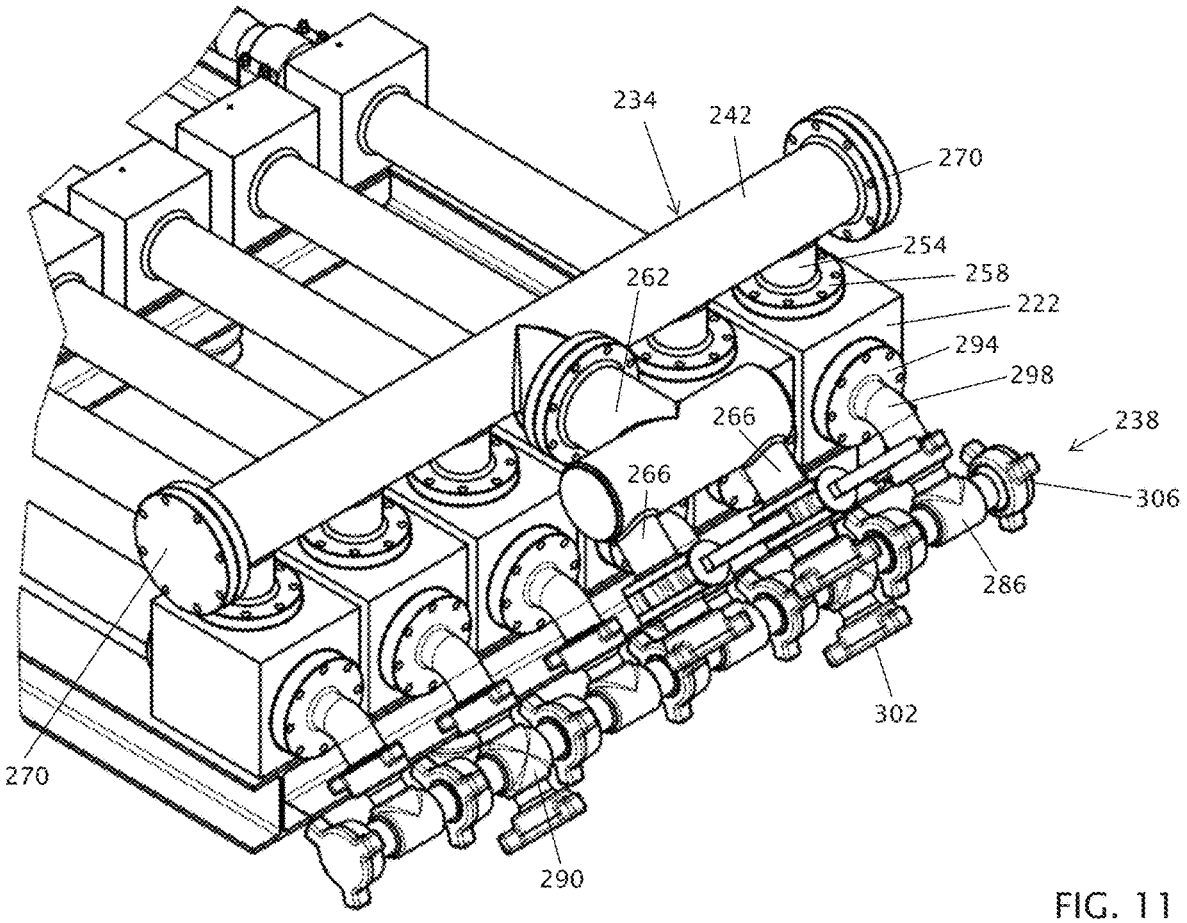
FIG. 11 depicts an enlarged perspective view of a working fluid manifold portion of the system of FIG. 4.
Figure 12:
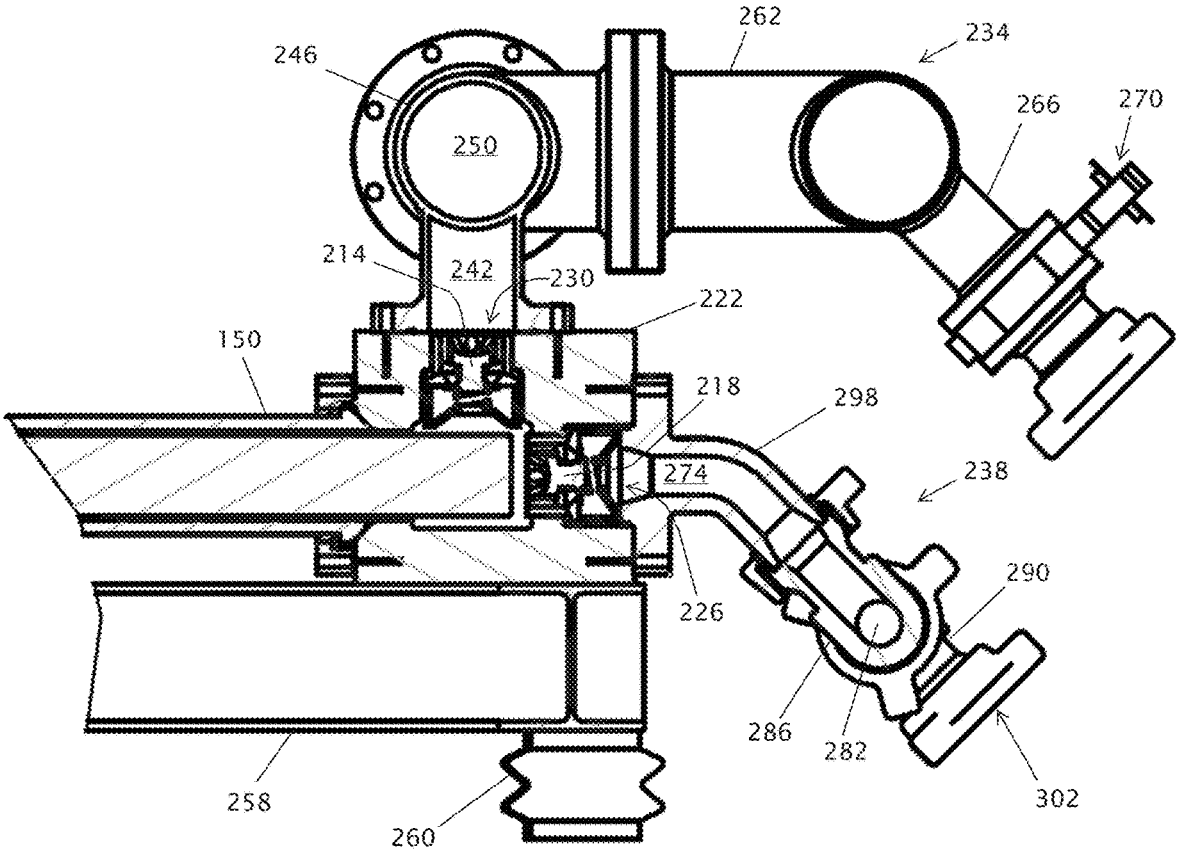
FIG. 12 depicts an enlarged, cross-sectional side view of working fluid end cylinder and working fluid manifold portion of the working fluid pump assembly.
Figure 13:
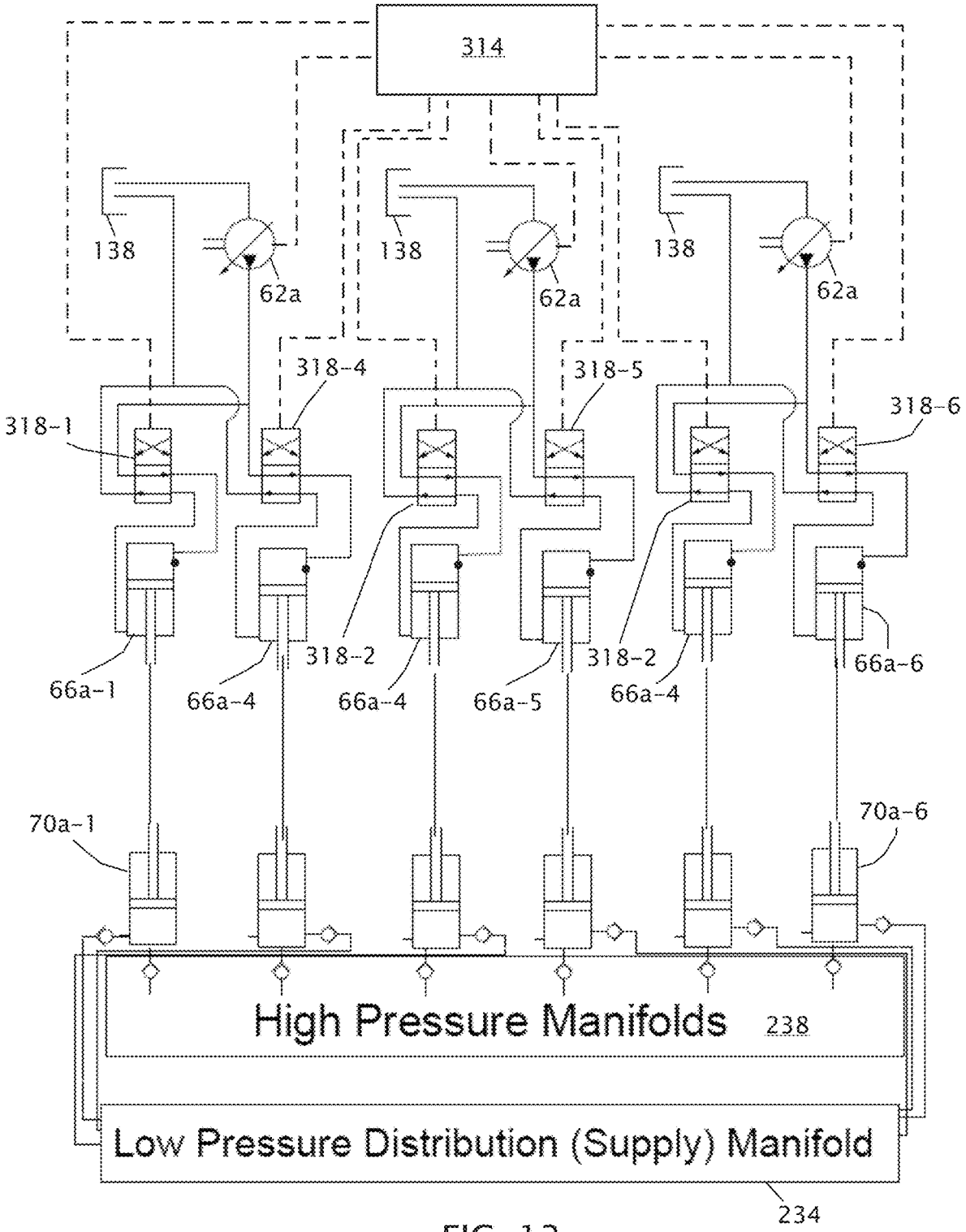
FIG. 13 depicts a schematic diagram of the system of FIG. 4.
Figure 14:
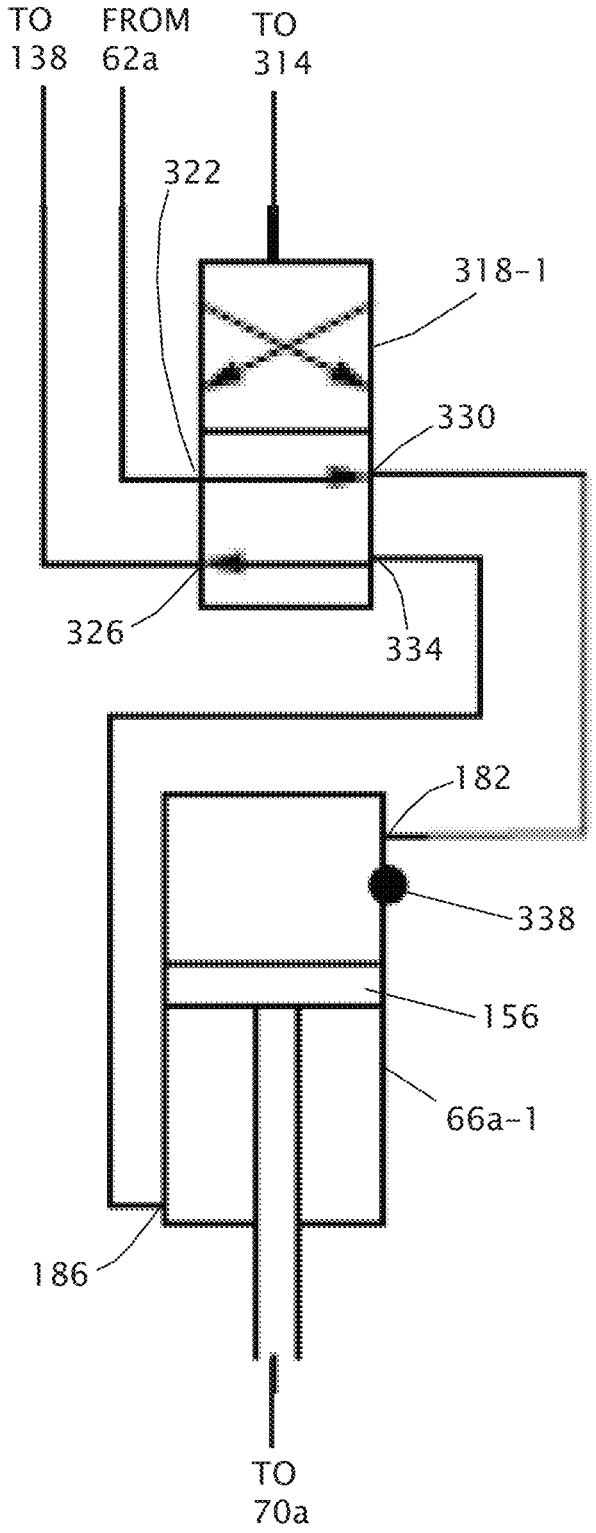
FIG. 14 depicts an enlarged portion of the schematic diagram of FIG. 13.

In the embodiment shown, rather than having an enlarged plunger head, the seal between housing 150 and plunger rod 86*a* is provided by an end seal or packing 206 that provides a tight seal around the outer surface, and assists with maintaining alignment, of the plunger rod. In this embodiment, for example, seal 206 comprises a hydraulic seal (pressurized via port 210), as illustrated in FIG. 10. In the depicted embodiment, during a forward stroke of pump assembly 82*a*, the volume of plunger rod 86*a* occupies a majority of the volume of the interior of housing 150, thereby reducing the volume available for working fluid and thereby forcing working fluid out of end cylinder 70*a*. The space between inner surface 150 and outer surface 198 can be selected to exceed the maximum transverse dimension (e.g., diameter) of any particulates (e.g., proppants) in the working fluid such that particles are not contacted by both surfaces at one, thereby reducing and/or eliminating abrasion of the respective surfaces. In some embodiments, the length of plunger rod 86*a* (e.g., and the length of the portion of the plunger rod that extends inward of seal 206) exceeds 12 inches (e.g., exceeds 40 inches and/or is between 50 inches and 60 inches). For example, in the embodiment shown, end cylinders 70*a* each have a stroke length of 48 inches.

In the embodiment shown, each working fluid pump assembly 82*a* (e.g., end cylinder 70*a*) further comprises an inlet check valve 214 coupled to end cylinder housing 150 and configured to permit working fluid to be drawn into the end cylinder housing but prevent working fluid from exiting the end cylinder housing through the inlet check valve. In operation of the system, the inlet check valve prevents working fluid from exiting through the fluid inlet thereby enabling working fluid to be pressurized in the cylinder and directed solely to the well. In this embodiment, each working fluid pump assembly 82*a* (e.g., end cylinder 70*a*) further comprises an outlet check valve 218 coupled to end cylinder housing 150 and configured to permit working fluid to exit the end cylinder housing while preventing working fluid from being drawn into the end cylinder housing. In operation of the system, the outlet check valve prevents working fluid pressurized downstream of the outlet check (e.g., in the outlet manifold described below) valve from entering the cylinder housing during the return stroke of plunger rod 86*a* (e.g., during the forward stroke of other working fluid pump assemblies). The outlet check valve and inlet check valve may, in some embodiments, be at least partially in the end cylinder housing. For example, in the embodiment shown, end cylinder housing 150 includes an end block 222 defining an outlet passage 226 (within which outlet check valve 218 is disposed), and an inlet passage 230 (within which inlet check valve 214 is disposed). In this embodiment, the outlet passage is substantially aligned with a longitudinal axis (and the direction of movement) of the plunger rod, such as, for example, to reduce "hammering" effects, mechanical stresses, and undesirable flow patterns that could otherwise result from forcing pressurized working fluid through a bend. In the depicted embodiment, the inlet passage is disposed at a 90 degree angle relative to the outlet passage, the orientation of which is functionally acceptable because the working fluid entering through the inlet is not pressurized to the same degree as working fluid exiting the exit check valve.

In the embodiment shown, system 50*a* further comprises a suction manifold 234 coupled to the inlet check valves (214) and inlet passages (230) of each working fluid pump assemblies 82*a*; and a discharge manifold 238 coupled to the outlet check valves (218) and outlet passages (226) of the working fluid pump assemblies. In this embodiment, suction manifold 234 includes a plurality of inlet flow channels 242 each coupled to a different one of the working fluid pump assemblies 82*a* via the corresponding inlet check valve (214) and inlet flow channel (230). In this embodiment, each inlet flow channel 242 has a cross-sectional area at least as large as the cross-sectional area of the interior of the working fluid end cylinder to which the inlet flow channel is coupled. For example, in the embodiment shown, inlet flow channel 242 has a circular cross-section with a diameter of 5 inches, and end cylinder housing 150 defines an interior having a circular cross-section with a diameter of 5 inches.

In the embodiment shown, suction manifold 234 includes a primary (e.g., tubular) member 246 defining a primary chamber 250 that extends laterally across all of the pump assemblies 82*a*. In this embodiment, suction manifold 234 also includes a plurality of connection (e.g., tubular) members 254 each defining an inlet flow channel 242 and connecting the primary chamber 250 with the inlet channel (218) of a respective end cylinder 70*a* (e.g., via a flange 258 that is removably coupled to the end block 222 of the respective end cylinder 70*a*, as shown). This embodiment of suction manifold 234 further includes an intake member 262 defining an intake passage in fluid communication with primary chamber 250, and dual intake ports 266 each controlled by a (e.g., butterfly) valve 270. In the depicted embodiment, the ends of primary member 246 are closed with end caps 274 that are removable to facilitate cleaning of suction manifold 234 (e.g., to remove slurry and/or particulates that may be deposited from the working fluid). End caps 274 may also be removed to use the ends of primary member 246 as additional or alternative inlets for working fluid. Similarly, in this embodiment, intake member 262 is coupled to primary member 246 via a flange and is thereby removable to further facilitate cleaning and/or replacement of the intake member. In the embodiment shown, primary chamber 250 has a circular cross-section with a diameter of 8 inches, intake member 262 has a circular cross-section with a diameter of 8 inches, and each of intake ports 266 has a circular cross-section with a diameter of 4 inches.

In the depicted embodiment, discharge manifold 238 includes a plurality of outlet flow channels 278 each coupled to a different one of the working fluid pump assemblies 82*a* via the corresponding outlet check valve (218) and outlet flow channel (226). In the depicted embodiment, at least a portion of each outlet flow channel 278 is axially aligned with the respective outlet flow passage 226 (and plunger rod 86*a*), as shown. In this embodiment, each outlet flow channel 278 has a cross-sectional area that is smaller than the cross-sectional area of the interior of the working fluid end cylinder to which the outlet flow channel is coupled. For example, in the embodiment shown, outlet flow channel 278 has a circular cross-section with a diameter of 3 inches, and end cylinder housing 150 defines an interior having a circular cross-section with a diameter of 5 inches.

In the embodiment shown, discharge manifold 238 includes a primary chamber 282 that extends laterally across all of the pump assemblies 82*a*. In this embodiment, primary chamber 282 is defined by the lateral portions of a plurality of (e.g., four, as shown) tee fittings 286 and a plurality of (e.g., two, as shown) cross-fittings 290. Each of fittings 286, 290 is coupled to one of pump assemblies 82*a* (e.g., end block 222 of the respective end cylinder housing 150) via a flange 294 of a 45-degree elbow fitting 298 that defines outlet flow channel 278. In this embodiment, the lower branches of cross fittings 290 provide outlet connections 302 that can be connected to the well to deliver facilitate the delivery of working fluid. As with the ends of primary member 150 of suction manifold 234, the ends of the outermost tee fittings that define discharge manifold 238 are covered by end plates 306 that are removable to facilitate cleaning and/or provide additional outlet connections. As shown, when not in use, outlet connections 302 are also covered with end plates (e.g., similar to end plates 306).

In the embodiment shown, system 50*a* also comprises a valve system 310 coupled to the source of pressurized driving fluid (variable-displacement pumps 62*a*) and to each hydraulic ram cylinder 66*a* of each of the working fluid pump assemblies to direct pressurized working fluid to and from the hydraulic ram cylinders. In this embodiment, system 50*a* also comprises a control system 314 coupled to valve system 310 and configured to sequentially actuate (by directing pressurized working fluid to ports 182, 186 of each hydraulic ram cylinder via valve system 310) the hydraulic ram cylinders to deliver (e.g., continuous and substantially pulseless) output flow of the working fluid from the pump system to the well.

As shown, valve system 310 comprises a plurality of (e.g., six, as shown) directional valves 318, one for each of hydraulic ram cylinders 66*a*. In the embodiment shown, each directional valve 318 includes two upstream ports 322, 326 (with first upstream port 322 coupled to a pump 62*a* and second upstream port 326 coupled to reservoir 138) and two downstream ports 330, 334 (with first downstream port 330 connected to port 182 of the hydraulic ram cylinder 66*a*, and second downstream port 334 connected to port 186 of the hydraulic ram cylinder 66*a*). In use, the direction valve can be electronically actuated (e.g., by control system 314) between: (1) a first configuration in which pressurized driving fluid is directed from pump 62*a*, through ports 322 and 330 of valve 318-1, and into port 182 of hydraulic ram cylinder 66*a*-1 to push piston 156 through its forward stroke, and (2) a second configuration in which pressurized driving fluid is directed from pump 62*a*, through ports 322 and 334 of valve 318-1, and into port 186 of hydraulic ram cylinder 66*a*-1 to push piston through its return stroke. During the forward stroke of piston 156, non-pressurized or low-pressure driving fluid is directed from port 186 of hydraulic ram cylinder 66*a*-1, through ports 334 and 326 of valve 318-1, and to reservoir 138. During the return stroke of piston 156, non-pressurized or low-pressure driving fluid is directed from port 182 of hydraulic ram cylinder 66*a*-1, through ports 330 and 326 of valve 318-1, and to reservoir 138.

In the embodiment shown, the rate at which piston 156 completes its forward and return strokes can be adjusted by varying the pressure and/or the rate at which pressurized driving fluid is delivered to hydraulic ram cylinder 66*a*-1. For example, assuming that driving fluid is delivered at a pressure that is sufficient to move piston 156, the faster the driving fluid is delivered to port 182, the faster piston 156 will complete its forward stroke. In some embodiments, and as described below, it may be advantageous for the return stroke to be completed faster (have a shorter duration) than the forward stroke. As such, in the depicted embodiment, pump 62*a* is a variable displacement pump that can be adjusted to vary the rate at which pressurized driving fluid is delivered from the pump. In this embodiment, pump 62*a* is connected to control system 314 such that the control system can electronically signal adjustments to the pump to increase or decrease displacement. In other embodiments, the valve system includes a plurality of electronically adjustable proportional flow valves each between one of pumps 62*a* and the corresponding directional valves 318, such that control system 314 can adjust the volume of flow to the respective hydraulic ram cylinders 66*a* to adjust the duration of the forward and return strokes.

In the embodiment shown, system 50*a* (e.g., control system 314) further comprises a a plurality of position sensors 338 each coupled to a different one of the hydraulic ram cylinders (e.g., 66*a*-1) and configured to detect the position of the ram piston (156) in the ram cylinder housing (154). For example, position sensor 338 can comprise a linear position sensor coupled to housing 154. In some embodiments, a position indicator (e.g., a magnet, RFID tag, and/or the like) can be coupled to piston 156 and/or piston rod 102*a* to cooperate (e.g., be located by) sensor 338. In other embodiments, position sensor 338 may be coupled to end cylinder housing 150 of end cylinder 70, a position indicator can be coupled to plunger rod 86*a*, and/or position sensors 338 and/or position indicators can be coupled to both of hydraulic ram cylinders 66*a* and end cylinders 70*a*. In operation, sensing the position of the piston (156) and/or plunger rod (86*a*) of each pump assembly 82*a* can assist control system 314 with maintain precise relative timing of the pump assemblies, such as, for example, to minimize and/or eliminate pulses in the flow of working fluid into the well, as described in more detail below.

In the embodiment shown, control system 314 comprises one or more processors and/or a programmable logic controllers (PLCs) configured to sequentially actuate working fluid pump assemblies 82*a* (i.e., via hydraulic ram cylinders 66*a*). Examples of suitable control systems are available from Wandfluh of America, Inc. In most embodiments, the present systems are configured to actuate the pump assemblies such that at least one of the pump assemblies is performing a forward stroke at any given point in time (e.g., such that the hydraulic ram cylinder of a first one of the working fluid pump assemblies is beginning its forward stroke as the hydraulic ram cylinder of a second one of the working fluid pump assemblies is ending its forward stroke). For example, in an embodiment with only two pump assemblies 82*a*, the first pump assembly would perform its forward stroke as the second pump assembly performs its return stroke of the same duration. In the embodiment shown, the fluid pump assemblies (82*a*) are included in a multiple of three (six) and are controlled as two groups of three.

Figure 7:
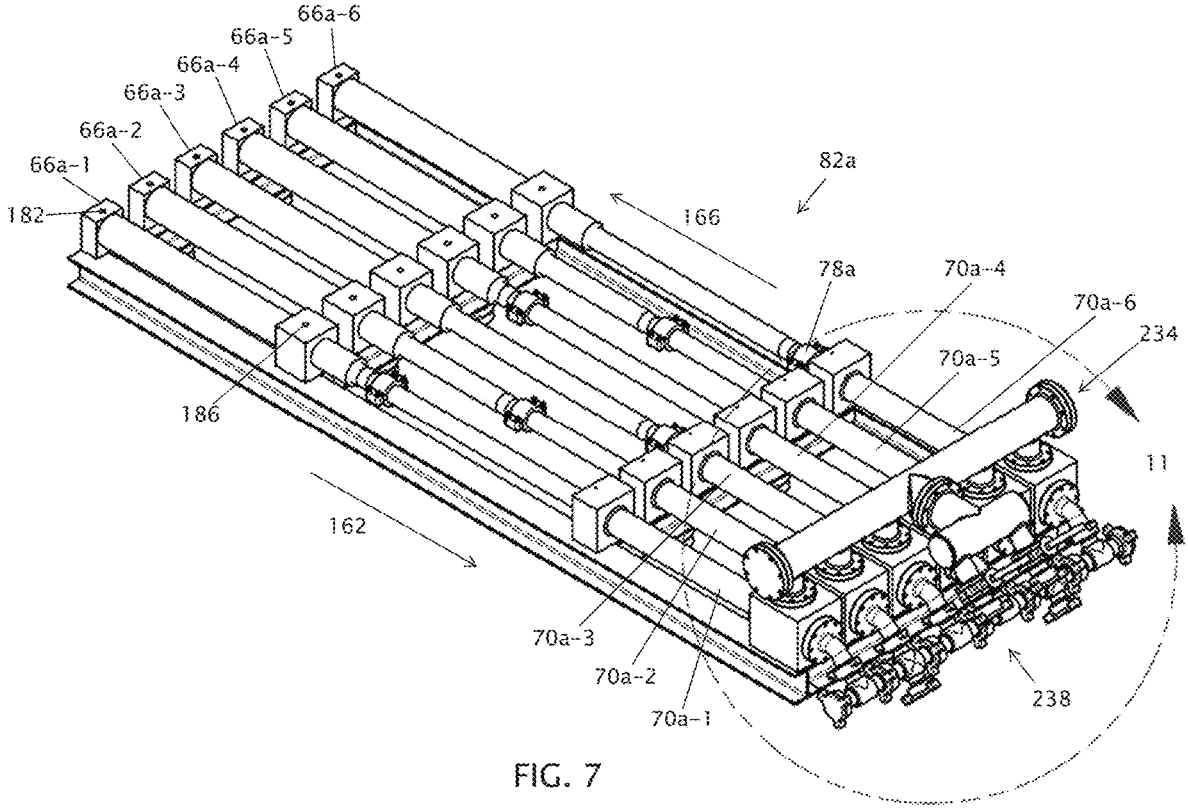
FIG. 7 depicts an enlarged, cutaway perspective view of a working fluid pump assembly portion of the system of FIG. 4.
Figure 8:
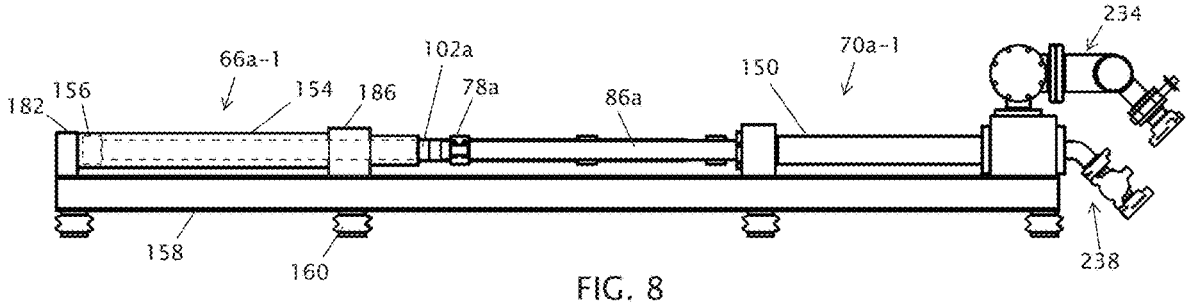
FIG. 8 depicts a cross-sectional side view of one of the working fluid pump assemblies of the system of FIG. 4.
Figure 9:
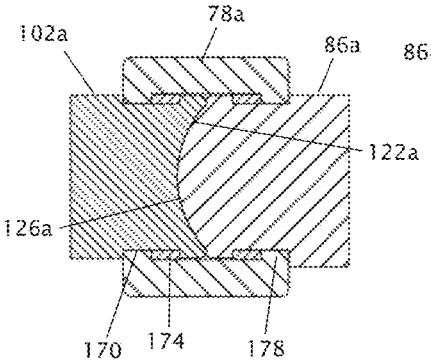
FIG. 9 depicts an enlarged, cross-sectional side view of a coupling member coupling a piston rod of the working fluid pump assembly to a plunger rod of the working fluid pump assembly.
Figure 16:
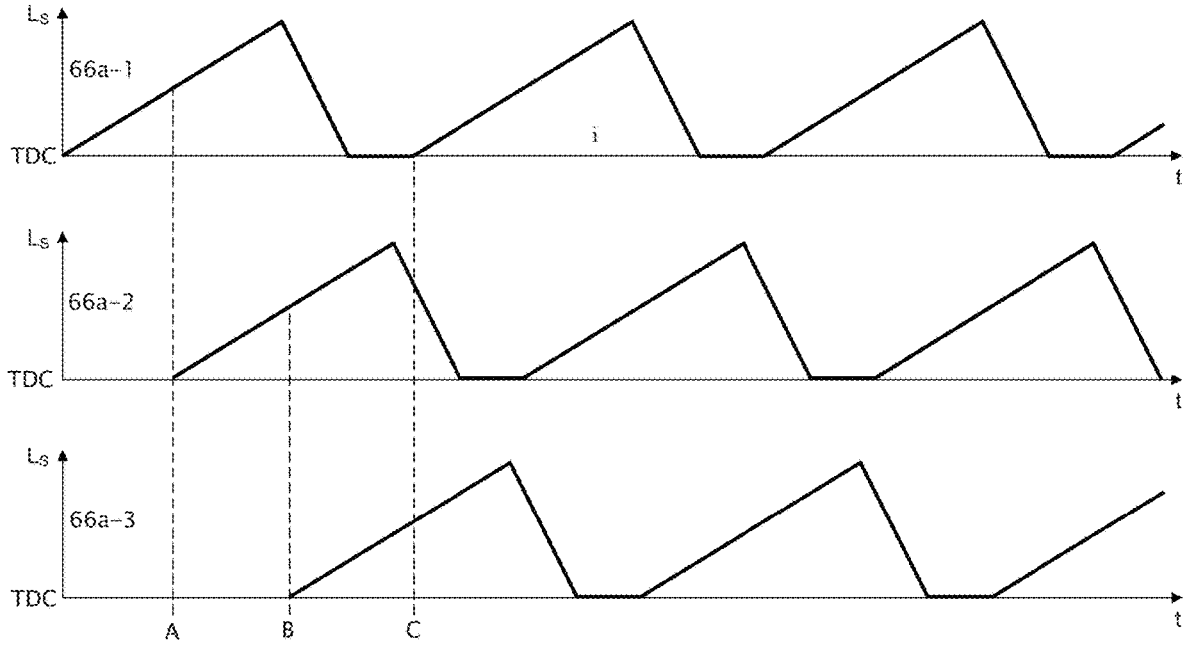
FIG. 16 illustrates an exemplary actuation sequence for the system of FIG. 4.

More particularly, and as illustrated in FIG. 7, the pistons (156) of the first and fourth hydraulic ram cylinders (66*a*-1 and 66*a*-4) are just beginning their forward stroke (which may be referred to as top dead center or TDC), the pistons (156) of the third and sixth hydraulic ram cylinders (66*a*-3 and 66*a*-6) are just ending their forward stroke (which may be referred to as bottom dead center or BDC), and the pistons (156) of the second and fifth hydraulic ram cylinders (66*a*-2 and 66*a*-5) are in the middle of their forward stroke (are halfway between TDC and BDC). For example, FIG. 16 illustrates the actuation of cylinders 66*a*-1, 66*a*-2, and 66*a*-3, from TDC to BDC ($L_S$), in which: at time "A," cylinder 66*a*-1 is halfway through its forward stroke and cylinder 66*a*-2 is begins its forward stroke; at time "B," cylinder 66*a*-2 is halfway through its forward stroke and cylinder 66*a*-3 beings its forward stroke; and, at time "C," cylinder 66*a*-1 has returned to TDC and is beginning a subsequent forward stroke. In use, these relative positions between the pistons is maintained during their forward strokes such that, at any given point in time at which any two of the pistons are at TDC, two of the other four pistons are at BDC, and the remaining two pistons are half way in between TDC and BDC. In use, these relative positions result in a relatively smooth and pulseless delivery of fluid to discharge manifold 238 and to a well. For example, in the positions illustrated in FIG. 7, the third and sixth end cylinders (70*a*-3 and 70*a*-6) have just stopped expelling working fluid into the discharge manifold (238), the first and fourth end cylinders (70*a*-1 and 70*a*-4) are just about to start expelling working fluid into the discharge manifold (238), and the second and fifth end cylinders (70*a*-2 and 70*a*-5) are expelling working fluid into the discharge manifold (238) at a substantially constant rate. To facilitate these relative relationships between the pistons, the return stroke must be equal to or less than one half of the duration of the forward stroke. For example, when the second and fifth end cylinders (70*a*-2 and 70*a*-5) reach BDC, the first and fourth end cylinders (70*a*-1 and 70*a*-4) will be halfway through their forward stroke, and the third and sixth end cylinders (70*a*-1 and 70*a*-4) must be at BDC and ready to begin their forward stroke. In some embodiments, the hydraulic ram cylinders (66*a*) are actuated (e.g., via adjustments to pumps 62*a* and/or valves 318 implemented by control system 314) such that the duration of the return stroke is less than half the duration of the forward stroke (for example, as illustrated in FIG. 16) such that each piston can be paused momentarily at TDC to enable the re-synchronization of the pistons every few strokes and/or on every stroke.

Figure 15:
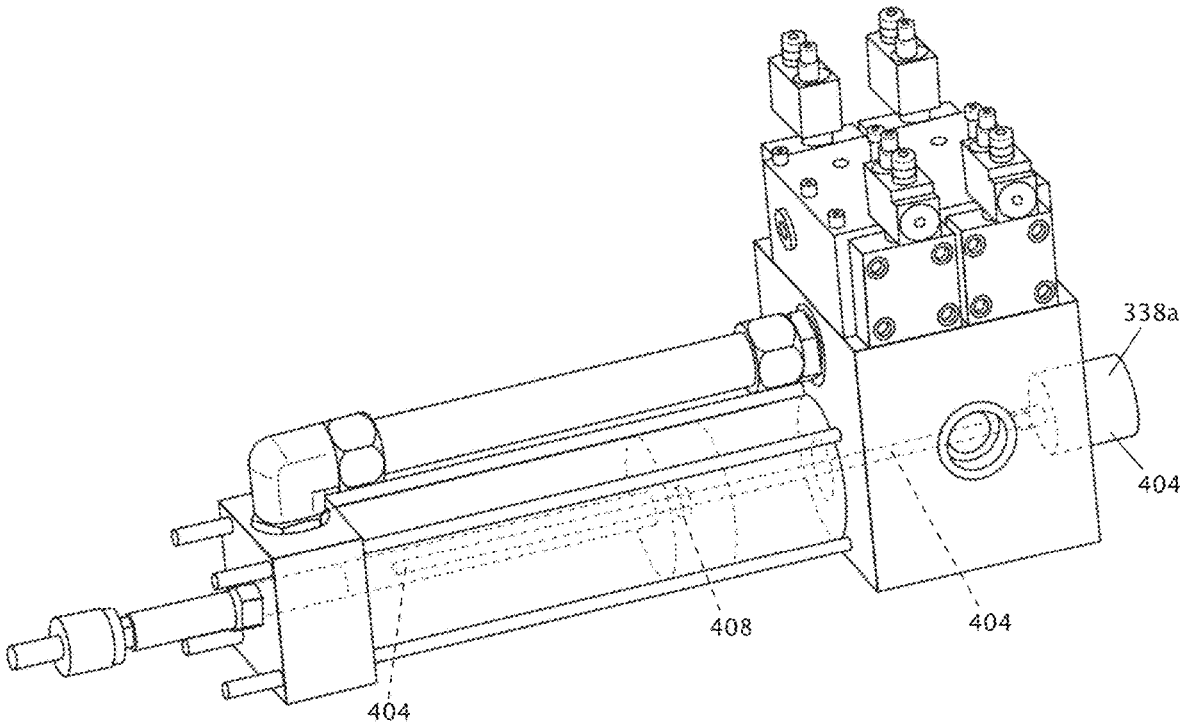
FIG. 15 depicts a perspective view of one example of a hydraulic cylinder with a position sensor that is suitable for at least some of the present systems.

FIG. 15 depicts a hydraulic ram cylinder with one example of a position sensor 338*a* that is suitable for at least some embodiments of the present systems. In the embodiment shown, sensor 338*a* is a magneto-inductive position sensor that comprises a base 400, elongated transducer element 404, and an oscillator 408. As shown, base 400 is coupled to the housing of the cylinder (e.g., 66*a*-1) and transducer element 404 extends coaxially with and into the piston (e.g., 156) and piston rod (102*a*), while oscillator 408 comprises an annular magnet coupled in fixed relation to the piston (e.g., 156) such that position of the oscillator and thereby the position of the piston can be detected as it moves relative to transducer element 404. Various sensors 338*a* are available, for example, from Balluff, Inc.

In the embodiment shown and having the dimensions described above, pump assemblies 82*a* are configured to deliver working fluid at pressures of up to 20,000 psi and to complete their forward strokes at linear rates of up to 150 feet per minute (2.5 feet per second, resulting in a duration of 1.6 seconds for a 48 inch stroke), for a collective pumping rate from all six pump assemblies 82*a* of about 7.4 barrels per minute.

The present pumps and pump systems have a number of advantages relative to prior art frac pumps. At least some embodiments of the present "linear" or axial configurations utilize a diesel engine, a hydraulic drive gear box, open loop hydraulic pumps, hydraulic ram cylinders, controls for the hydraulic system hydraulic cylinders, cylindrical fluid ends and a coupling to connect the hydraulic cylinders and the fluid end cylinders. In such embodiments, the engine powers the hydraulic system which, in turn, provides hydraulic fluid to operate the hydraulic cylinders, and the (e.g., polished) rod of the hydraulic ram cylinders is connected axially to the plunger rod of the working fluid end cylinder. Such a configuration eliminates any need for a crankshaft or automatic transmission.

Because the present configurations eliminate any need for a crankshaft, the stroke length can be greatly extended which can be an important factor, especially in the harsh environments that frac pumps may be required to operate. Prior art pump designs may operate at a crankshaft speed of up to 330 revolutions per minute (RPM), with the discharge at a right angle to the plunger. Such prior art designs have significant cyclic fatigue on the fluid end. The present embodiments, however, can include much longer stroke lengths (e.g., 48 inches or more) that can significantly reduce the working cycles per minute (e.g., by a factor of up to 7 to 8), and/or can include an in-line discharge outlet (and outlet passage at least part of which is axially aligned with the plunger) to eliminate right angle discharge components and thereby reduce metal fatigue in the working cylinder fluid ends.

Current and prior art frac pumps were designed for intermittent use, because of the speed the pump needs to operate and the short stroke. Therefore, with use in modern shale fracing applications, prior art pumps may have to be down-rated for current frac applications. In contrast, the present embodiments are able to operate for longer periods of time because the longer stroke length permit pumping with little or no metal fatigue, such that an operator can have fewer units on location for a frac job. For example, the longer stroke length can significantly reduce the number of strokes required to pump a given volume, and thereby reduce the rate at which the plunger must cycle, reducing fatigue and extending fluid end life. The reduction in cycling rate can also reduce fuel usage. Further, the present embodiments can reduce weight and lower the center of gravity of a system on a trailer, relative to a prior art system with a rotary pump.

Further, prior art frac pump designs generally must be completely shut down if one plunger bores is cracked or requires maintenance (e.g., one crack can cause the loss of 2,000+ HP), and an operator may need to bring surplus frac pump units to a location as a safety factor to ensure continuous operation. In contrast, in the present embodiments, each fluid end cylinder is completely separate from the others such that a single cylinder may be shut down and repaired while keeping the other cylinders in a system (e.g., 50*a*) operating, thereby reducing the need for additional surplus or backup systems and, in turn, reducing the necessary area or footprint of a job location. For example, in system 50*a* with six pump assemblies 82*a*, shut down of a single pump assembly 82*a* results in only 16% incremental decrease in system capacity.

Prior art frac pump designs typically use a rectangular fluid end that is monoblock design that can weigh as much as 6,000 lbs and which, if it fails on location, can require the entire unit to be taken out of line and taken back to the maintenance shop to be repaired. In contrast, in the embodiment of system 50*a* shown and described above, each end cylinder 70*a* is independently removable and will weigh about 1,000 lbs, making it relatively easy to replace end cylinders on location (e.g., by a field service truck that normally has a one-ton crane on board).

In the present embodiments, the use of directional control valves and proportional control valves can also reduce and/or eliminate the hammering effect that are sometimes encountered with the prior art crankshaft systems. The precise control of flow through system 50*a* facilitates smooth and constant flow, thereby significantly reducing the types of wear and fatigue that often caused iron to prematurely fail in the prior art systems. For example, the significant reduction in cyclic rate greatly reduces the number of possible pressure spikes, thereby extending the working life of hydraulic fluid. Vibrations are also reduced, and the linear design can substantially eliminate exposed rotating components.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments. For example, embodiments of the present methods and systems may be practiced and/or implemented using different structural configurations, materials, ionically conductive media, monitoring methods, and/or control methods.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A well service pump system for delivering fracturing fluid at high pressure to a well, the pump system comprising:

at least two working fluid pump assemblies, each comprising:

a working fluid end cylinder having an end cylinder housing, a plunger rod configured to reciprocate in the end cylinder housing; and a hydraulic ram cylinder having a ram cylinder housing, a ram piston configured to reciprocate in the ram cylinder housing, and a piston rod coupled to the ram piston and coupled to the plunger rod of the working fluid end cylinder such that the ram piston of the hydraulic ram cylinder can be actuated to move the plunger rod of the working fluid end cylinder:

in a first direction to expel working fluid from the end cylinder housing during a forward stroke of the plunger rod, and in a second direction to draw working fluid into the end cylinder housing during a return stroke of the plunger rod;

wherein the hydraulic ram cylinder housing includes a first port on a first side of the ram piston and second port on a second side of the ram piston;

a valve system configured to be coupled to a source of pressurized driving fluid and to the hydraulic ram cylinder of each of the working fluid pump assemblies to direct pressurized working fluid to and from the hydraulic ram cylinders, the valve system having, for each of the working fluid pump assemblies:

a directional control valve in fluid communication with the source of pressured driving fluid and each of the first port and the second port to selectively direct pressurized driving fluid to the first port or to the second port; and a control system coupled to the valve system and configured to sequentially actuate the hydraulic ram cylinders to deliver a continuous and substantially pulseless output flow of the working fluid from the pump system to the well;

wherein the control system is configured to actuate each hydraulic ram cylinder of each of the working fluid pump assemblies independently of each hydraulic ram cylinder of the other working fluid pump assemblies by actuating the directional control valve of the respective working fluid pump assembly between:

a first configuration in which fluid is directed from the source of pressurized driving fluid, through the directional control valve, and into the hydraulic ram cylinder housing via the first port to effectuate the forward stroke of the plunger rod; and a second configuration in which fluid is directed from the source of pressurized driving fluid, through the direction control valve, and into the hydraulic ram cylinder housing via the second port to effectuate the return stroke of the plunger rod.

2. The well service pump system of claim 1, further comprising:

the source of pressurized driving fluid.

3. The well service pump system of claim 1, where each working fluid pump assembly further comprises:

a coupling member coupled to the plunger rod of the working fluid end cylinder and to the piston rod of the hydraulic ram cylinder.

4. The well service pump system of claim 1, where in each working fluid pump assembly, the piston rod of the hydraulic ram cylinder is axially aligned with the plunger rod of the hydraulic ram cylinder.

5. The well service pump system of claim 1, where in each working fluid pump assembly, the end cylinder housing of the working fluid end cylinder has a cylindrical inner wall defining an end cylinder inner diameter, the plunger rod has an outer surface that is spaced apart from the cylindrical inner wall such that the working fluid end cylinder can pump abrasive fluids without the plunger rod and the end cylinder inner wall simultaneously contacting individual particles in the working fluid.

6. The well service pump system of claim 5, where the outer diameter of the plunger rod is between 85 percent and 95 percent of the inner diameter of the cylinder inner wall.

7. The well service pump system of claim 5, where the plunger rod has a length that exceeds 12 inches.

8. The well service pump system of claim 5, where the length of the plunger rod exceeds 40 inches.

9. The well service pump system of claim 8, where the length of the plunger rod is between 50 inches and 60 inches.

10. The well service pump system of claim 5, wherein the source of driving fluid comprises:

a diesel engine;

a hydraulic drive gear box coupled to an output shaft of the diesel engine; and one or more hydraulic pumps coupled to the hydraulic drive gear box.

11. The well service pump system of claim 10, where the hydraulic pump(s) each comprises a variable-displacement hydraulic pump.

12. The well service pump system of claim 10, where the working fluid pump assemblies do not include a crank shaft, and the system does not include an automatic transmission.

13. The well service pump system of claim 12, where each working fluid pump assembly further comprises:

an inlet check valve coupled to the end cylinder housing and configured to permit working fluid to be drawn into the end cylinder housing but prevent working fluid from exiting the end cylinder housing through the inlet check valve; and an outlet check valve coupled to the end cylinder housing and configured to permit working fluid to exit the end cylinder housing while preventing working fluid from being drawn into the end cylinder housing.

14. The well service pump system of claim 13, where in each working fluid pump assembly, the outlet check valve and inlet check valve are each disposed at least partially in the end cylinder housing.

15. The well service pump system of claim 13, further comprising:

a suction manifold coupled to the inlet check valves of the working fluid pump assemblies; and a discharge manifold coupled to the outlet check valves of the working fluid pump assemblies.

16. The well service pump system of claim 15, where the suction manifold includes a plurality of inlet flow channels each coupled to a different one of the working fluid pump assemblies via the corresponding inlet check valve, each inlet flow channel having a cross-sectional area at least as large as the cross-sectional area of the interior of the working fluid end cylinder of the coupled working fluid pump assembly.

17. The well service pump system of claim 15, where the discharge manifold includes a plurality of outlet flow channels each coupled to a different one of the working fluid pump assemblies via the corresponding outlet check valve, each outlet flow channel having a cross-sectional area that is smaller than the cross-sectional area of the interior of working fluid end cylinder of the coupled working fluid pump assembly.

18. The well service pump system of claim 1, where the directional control valve is configured to be electronically controlled to control the position of the corresponding ram piston.

19. The well service pump system of claim 1, where the control system comprises a processor or programmable logic controller (PLC) configured to sequentially actuate the working fluid pump assemblies such that the hydraulic ram cylinder of a first one of the working fluid pump assemblies is beginning its forward stroke as the hydraulic ram cylinder of a second one of the working fluid pump assemblies is ending its forward stroke.

20. The well service pump system of claim 19, where the processor or PLC is configured to sequentially actuate the working fluid pump assemblies such that the hydraulic ram cylinder of a third one of the working fluid pump assemblies is beginning its forward stroke when the hydraulic ram cylinder of the first one of the working fluid pump assemblies is one half of the way through its forward stroke.

21. The well service pump system of claim 20, where the two or more working fluid pump assemblies comprises a number of working fluid pump assemblies that is a whole multiple of three.

22. The well service pump system of claim 21, where the processor or PLC is configured to actuate each of the working fluid pump assemblies, via adjustment of the source of pressurized working fluid and/or adjustment of the valve system, such that the duration of its respective forward stroke is twice the duration of its respective return stroke.

23. The well service pump system of claim 19, where the control system further comprises:

a plurality of position sensors each coupled to a different one of the hydraulic ram cylinders and configured to detect the position of the ram piston in the ram cylinder housing.

24. The well service pump system of claim 23, where the processor or PLC is coupled to the plurality of position sensors and is further configured to adjust the timing of actuation of the working fluid pump assemblies based on the detected positions of the ram pistons.

25. A method comprising:

delivering fluid to a well with a well service pump system of claim 1.

26. The well service pump system of claim 1, wherein each working fluid pump assembly comprises a one-to-one ratio of working fluid end cylinders to hydraulic ram cylinders.

27. A well service pump system for delivering fracturing fluid at high pressure to a well, the pump system comprising:

at least two working fluid pump assemblies, each comprising:

a working fluid end cylinder having an end cylinder housing, a plunger rod configured to reciprocate in the end cylinder housing; and a hydraulic ram cylinder having a ram cylinder housing, a ram piston configured to reciprocate in the ram cylinder housing, and a piston rod coupled to the ram piston and coupled to the plunger rod of the working fluid end cylinder such that the ram piston of the hydraulic ram cylinder can be actuated to move the plunger rod of the working fluid end cylinder:

in a first direction to expel working fluid from the end cylinder housing during a forward stroke of the plunger rod, and in a second direction to draw working fluid into the end cylinder housing during a return stroke of the plunger rod;

wherein the hydraulic ram cylinder housing includes a first hydraulic port on a first side of the ram piston and a second hydraulic port on a second side of the ram piston;

at least two pumps, each coupled to a respective one of the working fluid pump assemblies to direct pressurized working fluid to each of:

the first hydraulic port to actuate the ram piston to drive the plunger rod in the first direction; and the second hydraulic port to actuate the ram piston to drive the plunger rod in the second direction; and a control system configured to sequentially actuate each hydraulic ram cylinder of each of the working fluid pump assemblies independently of each hydraulic ram cylinder of the other working fluid pump assemblies to deliver a continuous and substantially pulseless output flow of the working fluid from the pump system to the well.

28. The well service pump system of claim 1, where:

the ram piston is configured to seal against an inner surface of the ram cylinder housing such that the ram piston separates the ram cylinder housing between a first chamber and a second chamber;

the first port is in fluid communication with the first chamber; and the second port is in fluid communication with the second chamber.

29. The well service pump system of claim 27, wherein each working fluid pump assembly comprises a one-to-one ratio of working fluid end cylinders to hydraulic ram cylinders.

30. A well service pump system for delivering fracturing fluid at high pressure to a well, the pump system comprising:

at least three working fluid pump assemblies comprising a number of working fluid pump assemblies that is a whole multiple of three, each working fluid pump assembly comprising:

a working fluid end cylinder having an end cylinder housing, a plunger rod configured to reciprocate in the end cylinder housing; and a hydraulic ram cylinder having a ram cylinder housing, a ram piston configured to reciprocate in the ram cylinder housing, and a piston rod coupled to the ram piston and coupled to the plunger rod of the working fluid end cylinder such that the ram piston of the hydraulic ram cylinder can be actuated to move the plunger rod of the working fluid end cylinder:

in a first direction to expel working fluid from the end cylinder housing during a forward stroke of the plunger rod, and in a second direction to draw working fluid into the end cylinder housing during a return stroke of the plunger rod;

wherein the hydraulic ram cylinder housing includes a first port on a first side of the ram piston and second port on a second side of the ram piston;

a source of pressurized driving fluid in fluid communication with the hydraulic ram cylinder of each of the working fluid pump assemblies to direct pressurized working fluid to the hydraulic ram cylinder;

a control system configured to sequentially actuate each hydraulic ram cylinder of each of the working fluid pump assemblies independently of each hydraulic ram cylinder of the other working fluid pump assemblies to deliver a continuous and substantially pulseless output flow of the working fluid from the pump system to the well.

31. The well service pump system of claim 30, where the control system is configured to actuate each of the hydraulic ram cylinders, via adjustment of the source of pressurized working fluid, such that the duration of its respective forward stroke is twice the duration of its respective return stroke.

32. The well service pump system of claim 30, where the control system comprises a processor or programmable logic controller (PLC) configured to sequentially actuate the working fluid pump assemblies such that the hydraulic ram cylinder of a first one of the working fluid pump assemblies is beginning its forward stroke as the hydraulic ram cylinder of a second one of the working fluid pump assemblies is ending its forward stroke.

33. The well service pump system of claim 32, where the processor or PLC is configured to sequentially actuate the working fluid pump assemblies such that the hydraulic ram cylinder of a third one of the working fluid pump assemblies is beginning its forward stroke when the hydraulic ram cylinder of the first one of the working fluid pump assemblies is one half of the way through its forward stroke.

34. The well service pump system of claim 30, wherein each working fluid pump assembly comprises a one-to-one ratio of working fluid end cylinders to hydraulic ram cylinders.

* * * * *